US011041432B1

(12) United States Patent
Chen

(10) Patent No.: US 11,041,432 B1
(45) Date of Patent: Jun. 22, 2021

(54) CYLINDER STRUCTURE OF INTERNAL COMBUSTION ENGINE

(71) Applicant: Chun-Li Chen, Changhua County (TW)

(72) Inventor: Chun-Li Chen, Changhua County (TW)

( * ) Notice: Subject to any disclaimer, the term of this patent is extended or adjusted under 35 U.S.C. 154(b) by 0 days.

(21) Appl. No.: 17/028,875

(22) Filed: Sep. 22, 2020

(51) Int. Cl.

| | |
|---|---|
| ***F02B 25/14*** | (2006.01) |
| ***F02F 1/22*** | (2006.01) |
| ***F02F 1/42*** | (2006.01) |
| ***F02B 25/18*** | (2006.01) |
| ***F02F 1/00*** | (2006.01) |
| ***F02F 3/24*** | (2006.01) |

(52) U.S. Cl.
CPC ..... *F02B 25/14* (2013.01); *F02B 25/18* (2013.01); *F02F 1/004* (2013.01); *F02F 1/22* (2013.01); *F02F 1/4285* (2013.01); *F02F 3/24* (2013.01)

(58) Field of Classification Search
CPC ..... F02B 25/145; F02B 25/14; F02B 25/18; F02B 25/02; F02B 25/00; F02B 33/04; F02B 29/00; F02F 1/22; F02F 1/004; F02F 1/4285; F02F 3/24; F02F 2200/06; F02F 7/0036
See application file for complete search history.

(56) References Cited

U.S. PATENT DOCUMENTS

| | | | | |
|---|---|---|---|---|
| 6,491,006 | B2 * | 12/2002 | Jonsson | F02B 33/04 123/73 R |
| 7,066,120 | B2 * | 6/2006 | Geyer | F02B 63/02 123/195 C |
| 7,415,949 | B2 * | 8/2008 | Carlsson | F02B 25/22 123/73 A |
| 8,550,043 | B2 * | 10/2013 | Naganuma | F02B 25/14 123/73 PP |
| 8,833,316 | B2 * | 9/2014 | Ono | F02B 33/04 123/73 PP |
| 8,919,305 | B2 * | 12/2014 | Volckart | F02B 25/14 123/73 R |
| 9,175,598 | B2 * | 11/2015 | Geyer | F02F 1/22 |
| 9,359,937 | B2 * | 6/2016 | Ichihashi | F02B 33/28 |
| 9,702,318 | B2 * | 7/2017 | Geyer | F02B 75/02 |
| 10,145,293 | B2 * | 12/2018 | Huang | F01P 1/02 |
| 10,526,997 | B2 * | 1/2020 | Chen | F02F 1/004 |
| 2009/0095269 | A1 * | 4/2009 | Zama | F02F 3/24 123/73 A |

(Continued)

*Primary Examiner* — Grant Moubry
(74) *Attorney, Agent, or Firm* — Pai Patent & Trademark Law Firm; Chao-Chang David Pai

(57) ABSTRACT

A cylinder structure of an internal combustion engine contains: a body, two lids, and multiple positioning elements. The body has a combustion chamber, an air inlet, an air outlet, and two scavenging units. A respective scavenging unit has a first scavenging orifice, a second scavenging orifice, a first fringe, a second fringe, a first engagement portion, and a first fixing orifice. The two lids are configured to close the first scavenging orifice and the second scavenging orifice, an air conduit is defined between a respective lid and an external fence of the body, and the respective lid has multiple second fixing orifices. A respective positioning element has a stem and at least one hook, the stem extends into the first engagement portion, and the stem is rotated so that the at least one hook contacts with the respective lid, and the respective lid is connected with the body.

9 Claims, 7 Drawing Sheets

(56) References Cited

U.S. PATENT DOCUMENTS

| | | | | |
|---|---|---|---|---|
| 2010/0236082 | A1* | 9/2010 | Naganuma ..... | F02B 25/14<br>30/381 |
| 2011/0247601 | A1* | 10/2011 | Laydera-Collins ..... | F02B 33/04<br>123/73 PP |
| 2017/0175615 | A1* | 6/2017 | Yamazaki ..... | F02B 25/22 |

* cited by examiner

CYLINDER STRUCTURE OF INTERNAL COMBUSTION ENGINE

FIELD OF THE INVENTION

The present invention relates to a cylinder, and more particularly to a cylinder structure of an internal combustion engine which is manufactured easily and quickly.

BACKGROUND OF THE INVENTION

A conventional cylinder structure of an internal combustion engine is disclosed in U.S. Pat. No. 10,526,997 and contains a body, a cylinder head, a molybdenum coating layer, and two lids. The molybdenum coating layer is configured to enhance abrasion resistance and heat dissipation of the body. Preferably, the molybdenum coating layer is detachable to be replaced easily.

When connecting the two lids to the body, an airtight material (such as anaerobic curing acrylate) is adhered on the body auxiliarily so as to close a first scavenging orifice and a second scavenging orifice, and an air conduit is defined between a respective lid and the external fence and is formed in an inverted U shape, thus obtaining heat dissipation.

However, it is a long time to wait solidification of the airtight material. For example, a semi-finished cylinder is moved to another work platform for solidification after gluing. During the solidification, the two lids are removed easily in case semi-finished cylinder is delivered by an external force, and an airtight effect reduces as well.

The present invention has arisen to mitigate and/or obviate the afore-described disadvantages.

SUMMARY OF THE INVENTION

The primary objective of the present invention is to provide a cylinder structure of an internal combustion engine which contains two lids and a cylinder connected securely and easily by using multiple positioning elements before the airtight material solidifies.

To obtain the above objective, a cylinder structure of an internal combustion engine provided by the present invention contains: a body, two lids, and multiple positioning elements.

The body has a combustion chamber surrounded by an external fence and a cylinder head, an air inlet defined on a first side of the combustion chamber, an air outlet formed on a second side of the combustion chamber, and two scavenging units formed on the combustion chamber and intersecting with the air inlet and the air outlet. A respective scavenging unit has a first scavenging orifice, a second scavenging orifice, a first fringe and a second fringe which are configured to surround the first scavenging orifice and the second scavenging orifice, a first engagement portion arranged between the first fringe and the second fringe, and a first fixing orifice defined on the first fringe.

The two lids cover the two scavenging units so as to close the first scavenging orifice and the second scavenging orifice, and an air conduit is defined between a respective lid and the external fence, such that when the internal combustion engine scavenges exhaust airs, the exhaust airs are drawn into the first scavenging orifice and are discharged out of the air outlet via the air conduit and the second scavenging orifice, and the respective lid has multiple second fixing orifices located on an internal wall thereof.

A respective positioning element has a stem and at least one hook which extends from a first end of the stem, the stem extends into the first engagement portion along the first fixing orifice and a respective second fixing orifice, and the stem is rotated so that the at least one hook contacts with the respective lid, and the respective lid is connected with the body.

Thereby, the two lids and the body are connected easily by way of the multiple positioning elements and are adhered securely.

DETAILED DESCRIPTION OF THE PREFERRED EMBODIMENTS

Figure 2:
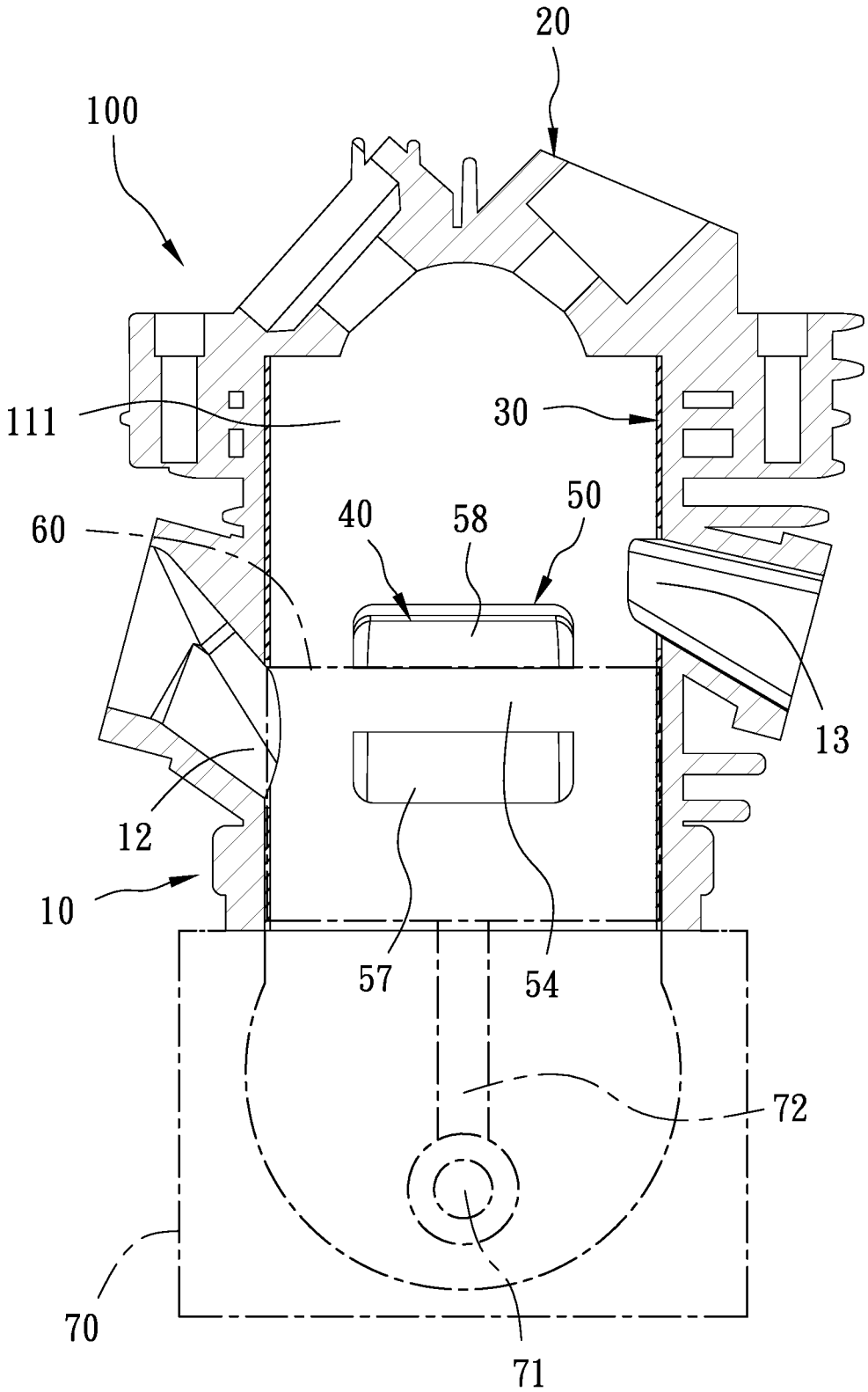
FIG. 2 is a cross sectional view showing the assembly of the cylinder structure of the internal combustion engine according to the preferred embodiment of the present invention.

A cylinder structure of an internal combustion engine according to a preferred embodiment of the present invention comprises: a cylinder 100 including a piston 60 received in the cylinder 100, and a crankcase 70 connected on a bottom of the cylinder 100, the crankcase 70 having a crankshaft 71 accommodated in the crankcase 70, and the crankcase 70 having a connection rod 72 connected between the crankshaft 71 and the piston 60 so as to actuate the piston 60 to move upward and downward, as shown in FIG. 2.

Figure 1:
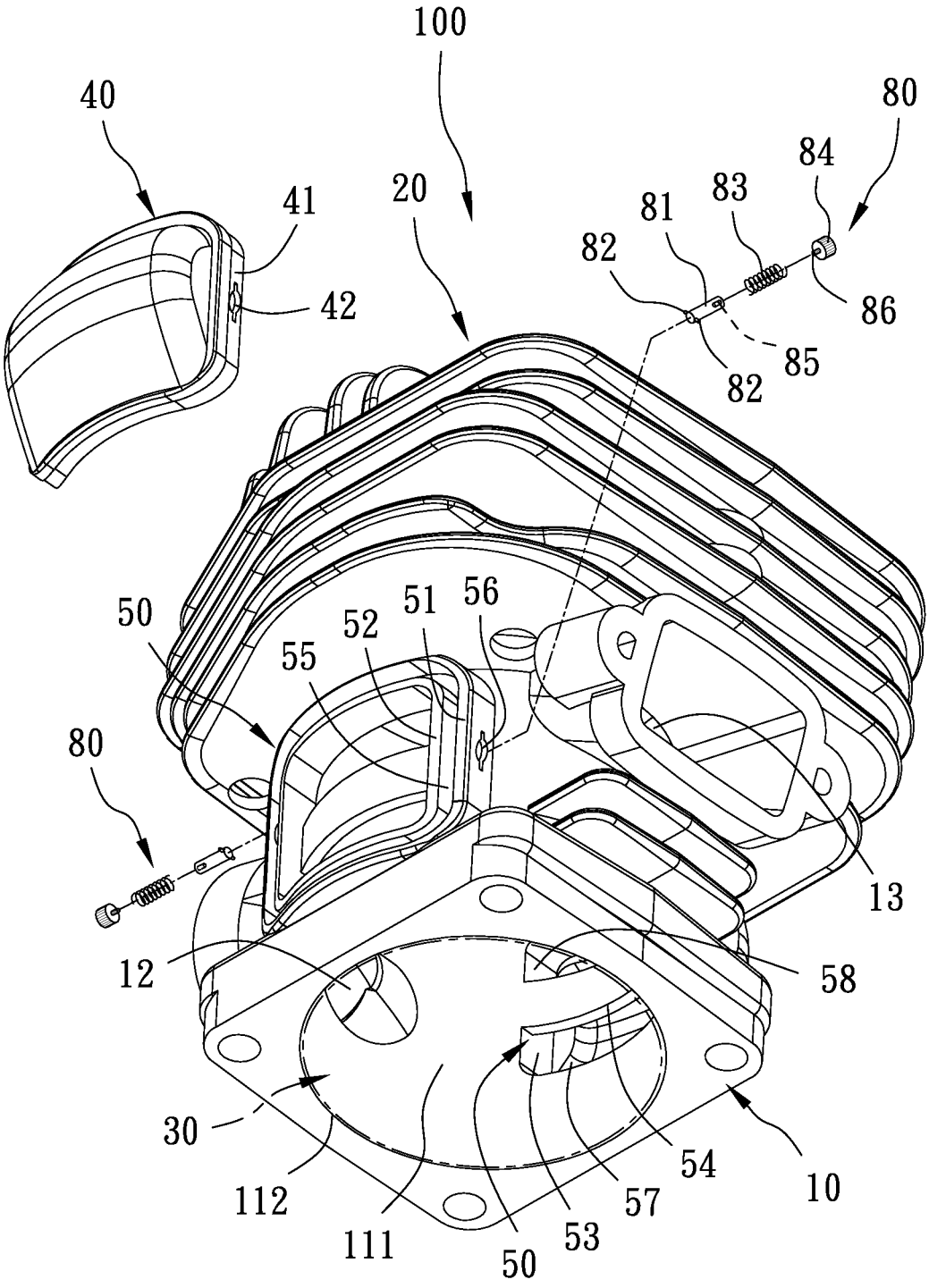
FIG. 1 is a perspective view showing the exploded components of a cylinder structure of an internal combustion engine according to a preferred embodiment of the present invention.
Figure 3:
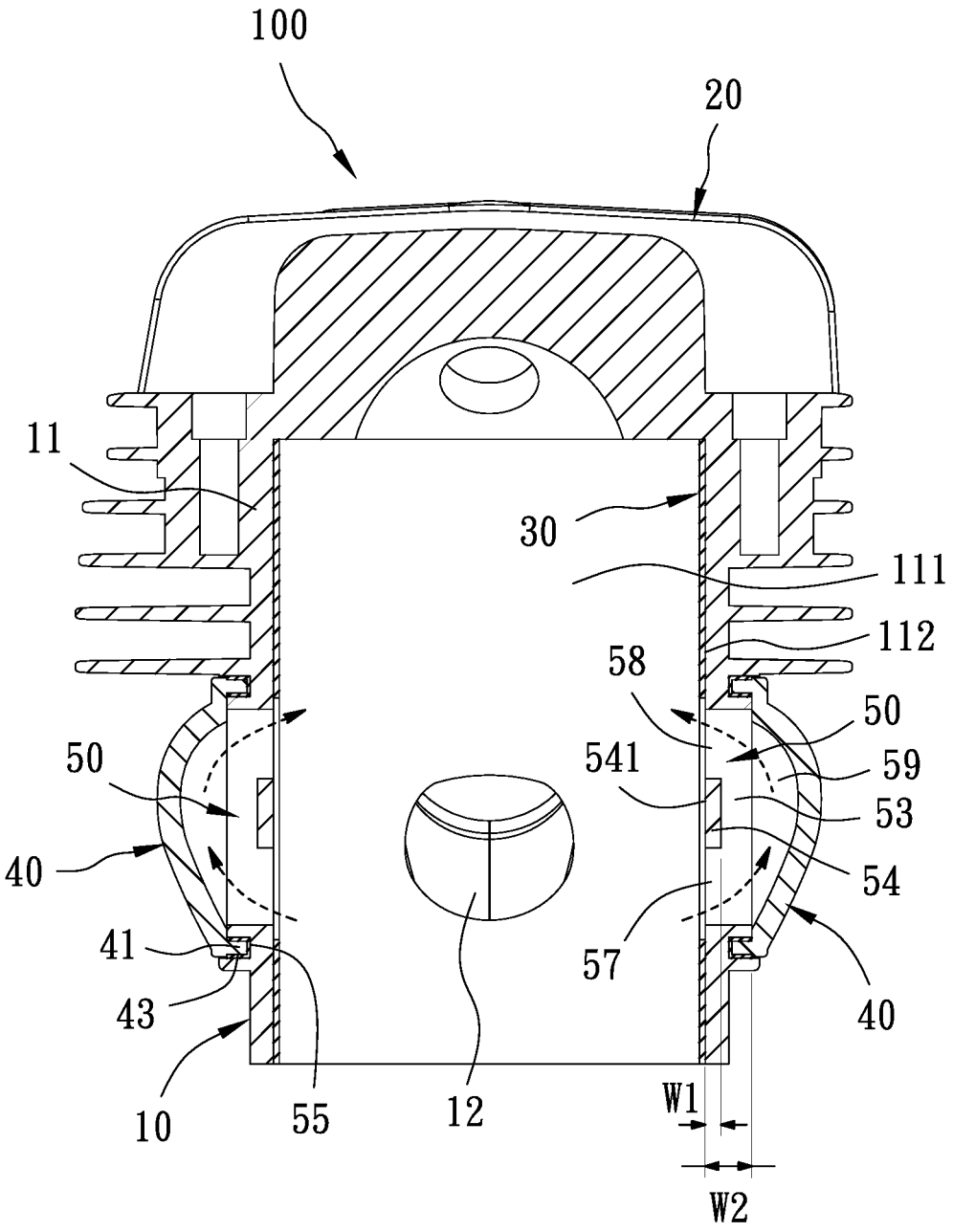
FIG. 3 is another cross sectional view showing the assembly of the cylinder structure of the internal combustion engine according to the preferred embodiment of the present invention.

With reference to FIGS. 1-3, the cylinder 100 includes a body 10, a cylinder head 20, a molybdenum coating layer 30, two lids 40, and multiple positioning elements 80.

The body 10 is die-casting molded from aluminum and has a combustion chamber 111 surrounded by an external fence 11 and the cylinder head 20, an air inlet 12 defined on a first side of the combustion chamber 111, an air outlet 13 formed on a second side of the combustion chamber 111, and two scavenging units 50 formed on the combustion chamber 111 and intersecting with the air inlet 12 and the air outlet 13.

A respective scavenging unit 50 has a groove 53 surrounded by a first fringe 51 and a second fringe 52, a rib 54 horizontally connected with a middle section of the groove 53, a first engagement portion 55 arranged between the first fringe 51 and the second fringe 52, and a first fixing orifice 56 defined on the first fringe 51, wherein a first scavenging orifice 57 and a second scavenging orifice 58 are formed among two sides of the rib 54 and the groove 53, a thickness of the rib 54 is less than a depth of the groove 53, an inner wall of the rib 54 flushes with an internal portion 112 of the external fence 11. Furthermore, a thickness W1 of the rib 54 is less than a depth W2 of the groove 53, and the inner wall 541 of the rib 54 flushes with the internal portion 112 of the external fence 11, as illustrated in FIGS. 1 and 3.

The molybdenum coating layer 30 is a molybdenum film coated on the internal portion 112 of the external fence 11 of the body 10, and the molybdenum coating layer 30 is selected from any one of Molybdenum disulfide (MoS 2), Molybdenum Dialkyl Dithiocarbamate (MoDTC), Molybdenum Dialkyldithiophosphoramidate, and an organic molybdenum mixture.

A respective lid 40 extrudes outward and covers the respective scavenging unit 50 so as to close the first scavenging orifice 57 and the second scavenging orifice 58, and an air conduit 59 is defined between the respective lid 40 and the external fence 11 and is formed in an U shape, such that when the internal combustion engine scavenges exhaust airs, the exhaust airs are drawn into the first scavenging orifice 51 and are discharged out of the air outlet 13 via the air conduit 55 and the second scavenging orifice 58.

Figure 4:
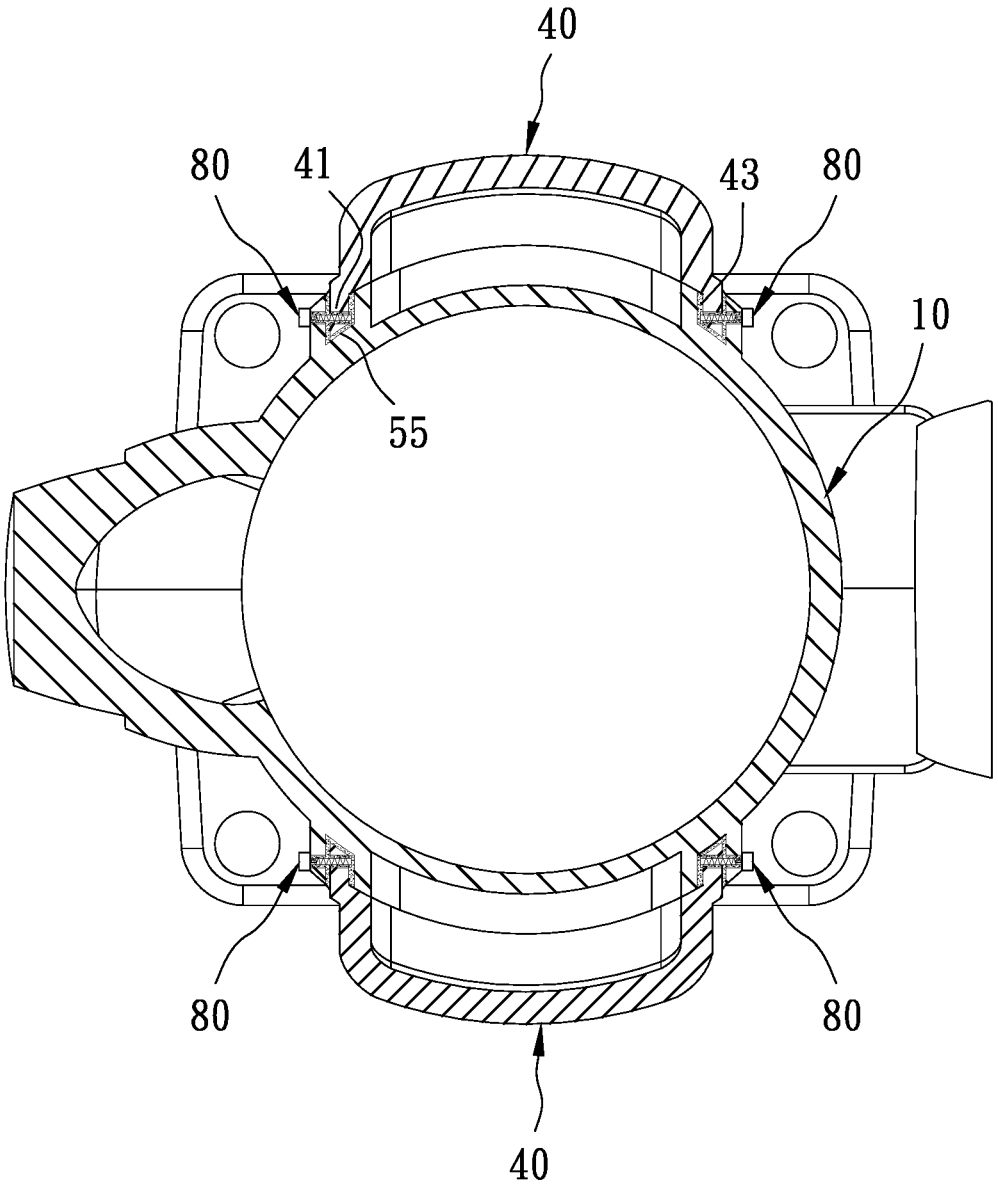
FIG. 4 is also another cross sectional view showing the assembly of the cylinder structure of the internal combustion engine according to the preferred embodiment of the present invention.
Figure 5:
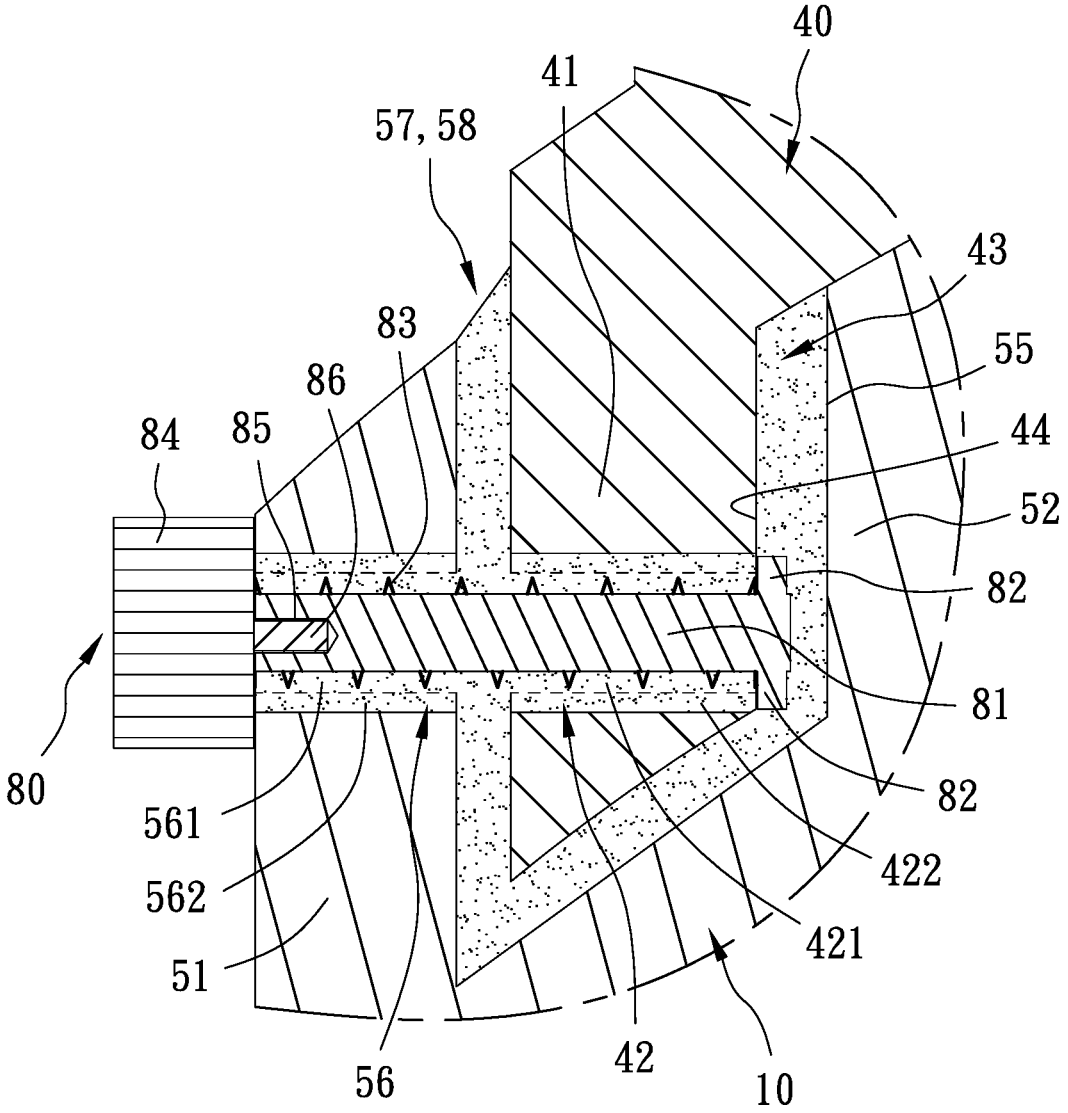
FIG. 5 is an amplified cross-sectional view showing the operation of a part of the cylinder structure of the internal combustion engine according to the preferred embodiment of the present invention.

Referring to FIGS. 4 and 5, the respective lid 40 has a second engagement portion 41 formed on a peripheral side thereof, and the respective lid 40 has multiple second fixing orifices 42 passing through the second engagement portion 41 and being coaxial to the first fixing orifice 56. In this embodiment, the first engagement portion 55 of the body 10 is concaved, and the second engagement portion 41 of the respective lid 40 is convex.

As shown in FIG. 5, a respective positioning element 80 has a stem 81, multiple hooks 82 extending from a first end of the stem 81, a spring 83, a protrusion 84 fixed on a second end of the stem 81, a threaded orifice 85 defined on the second end of the stem 81, and a screw peg 86 extending from the protrusion 84. In assembly, the spring 83 is fitted on the stem 81, and the screw peg 86 of the protrusion 84 is screwed in the threaded orifice 85 of the stem 81, such that the stem 81, the spring 83, and the protrusion 84 are connected, and the spring 83 abuts against the multiple hooks 82 and the protrusion 84.

The first fixing orifice 56 of the body 10 has a first receiving portion 561, a diameter of the first receiving portion 561 is more than a diameter of the stem 81, and the first fixing orifice 56 further has multiple first extensions 562 extending outward from the first receiving portion 561. A respective second fixing orifice 42 of the respective lid 40 has a second receiving portion 421, and a diameter of the second receiving portion 421 is more than a diameter of the stem 81, the respective second fixing orifice 42 further has multiple second extensions 422 extending outward from the second receiving portion 421.

Figure 6:
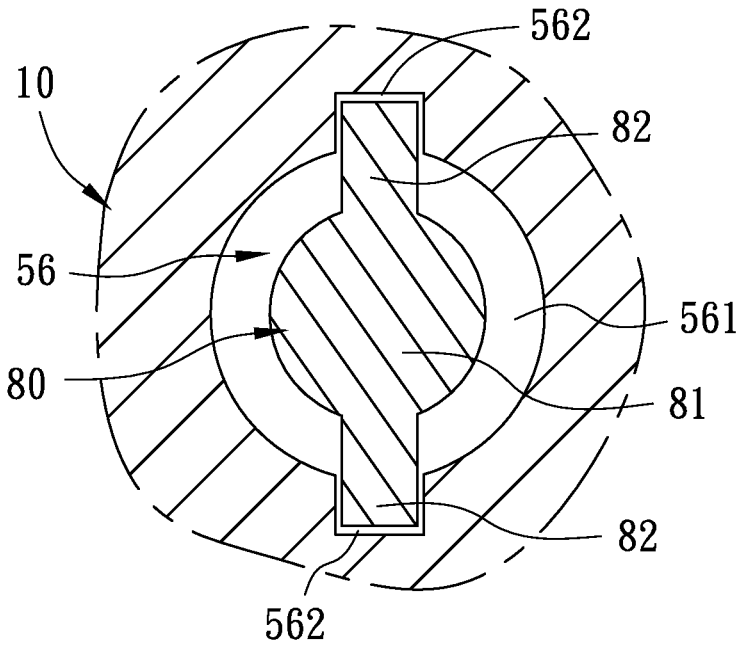
FIG. 6 is another amplified cross-sectional view showing the operation of a part of the cylinder structure of the internal combustion engine according to the preferred embodiment of the present invention.
Figure 7:
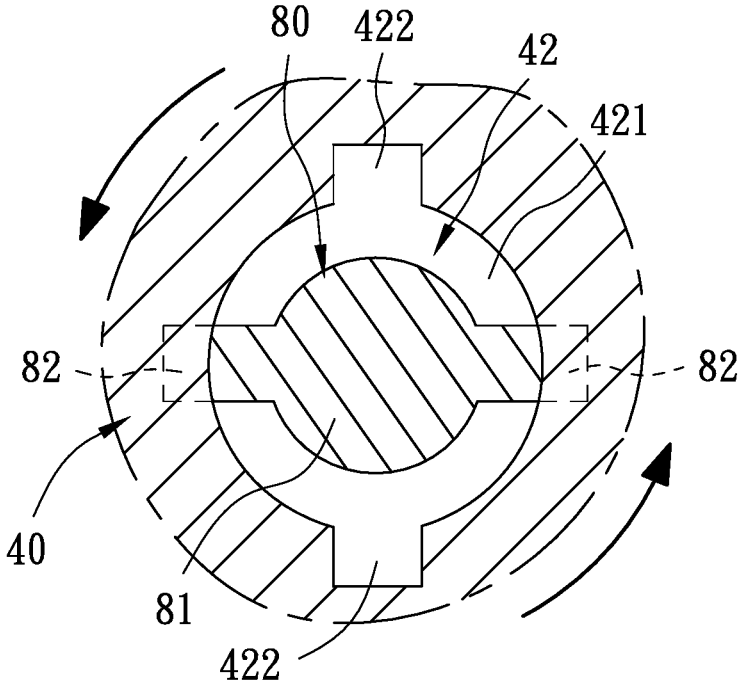
FIG. 7 is a cross sectional view showing the operation of a part of the cylinder structure of the internal combustion engine according to the preferred embodiment of the present invention.

When connecting the respective lid 40, as shown in FIG. 5, an airtight material 43 is fed into the first engagement portion 55 of the body 10, and the second engagement portion 41 of the respective lid 40 is inserted into the first engagement portion 55 of the body 10. Referring further to FIGS. 6 and 7, the stem 81 of the respective positioning element 80 is aligned with the first receiving portion 561 of the first fixing orifice 56 of the body 10, the multiple hooks 82 of the stem 81 are aligned with the multiple first extensions 562, and the respective positioning element 80 is inserted through the first fixing orifice 56 and the respective second fixing orifice 42 so that the stem 81 and the multiple hooks 82 are inserted through the second receiving portion 421 and the multiple second extensions 422 of the respective second fixing orifice 42, the protrusion 84 is grasped manually, and the stem 81 is rotated (as shown in FIG. 7) so that the multiple hooks 82 detach from the multiple second extensions 422 and engage with an internal wall of the respective lid 40, thus connecting the respective lid 40. Thereafter, the respective positioning element 80, the respective lid 40, and the body 10 are fixed by the spring 83. Preferably, the stem 81 is rotated smoothly because the airtight material 43 does not solidify when rotating the stem 81.

Figure 8:
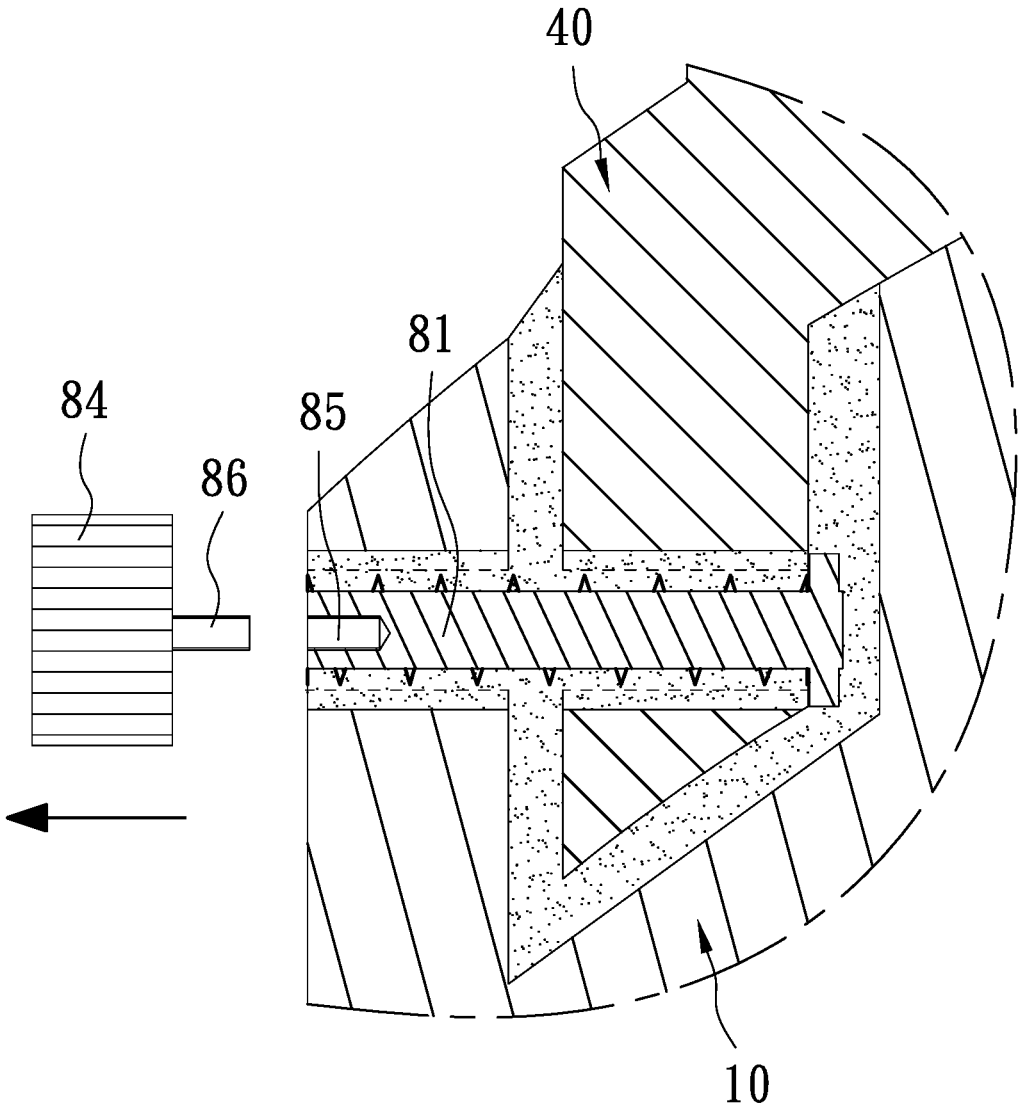
FIG. 8 is also another amplified cross-sectional view showing the operation of a part of the cylinder structure of the internal combustion engine according to the preferred embodiment of the present invention.

With reference to FIG. 8, after the respective lid 40 is connected with the body 10, the screw peg 86 of the protrusion 84 is removed from the threaded orifice 85 of the stem 81, such that the protrusion 84 is detachable from the stem 81, thus obtaining aesthetics appearance of the body 10.

Thereby, the respective positioning element 80, the respective lid 40, and the body 10 are connected, and when a semi-finished cylinder is moved to a work platform for solidifying, the respective lid 40 is connected with the body 10 securely even through the respective lid 40 does not solidify. Preferably, the respective lid 40 is connected with the body 10 easily, and an airtight effect produces between the respective lid 40 and the body 10 to close the first scavenging orifice 57 and the second scavenging orifice 58 tightly. In this embodiment, the airtight material 43 is anaerobic curing acrylate.

Accordingly, the cylinder structure of the internal combustion engine is connected by the multiple positioning elements to facilitate secure connection of the respective lid and the body. Preferably, the molybdenum coating layer is coated on the internal portion of the body to enhance lubrication, abrasion resistance, and heat dissipation and to reduce friction.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A cylinder structure of an internal combustion engine comprising:

a body having a combustion chamber surrounded by an external fence and a cylinder head, an air inlet defined on a first side of the combustion chamber, an air outlet formed on a second side of the combustion chamber, and two scavenging units formed on the combustion chamber and intersecting with the air inlet and the air outlet, wherein a respective scavenging unit has a first scavenging orifice, a second scavenging orifice, a first fringe and a second fringe which are configured to surround the first scavenging orifice and the second scavenging orifice, a first engagement portion arranged between the first fringe and the second fringe, and a first fixing orifice defined on the first fringe;

two lids covering the two scavenging units so as to close the first scavenging orifice and the second scavenging orifice, and an air conduit being defined between a respective lid and the external fence, such that when the internal combustion engine scavenges exhaust airs, the exhaust airs are drawn into the first scavenging orifice and are discharged out of the air outlet via the air conduit and the second scavenging orifice, and the respective lid has multiple second fixing orifices located on an internal wall thereof; and multiple positioning elements, wherein a respective positioning element has a stem and at least one hook which extends from a first end of the stem, the stem extends into the first engagement portion along the first fixing orifice and a respective second fixing orifice, and the stem is rotated so that the at least one hook contacts with the respective lid, and the respective lid is connected with the body.

2. The cylinder structure as claimed in claim 1, wherein the respective scavenging unit has a groove surrounded by the first fringe and the second fringe, a rib horizontally connected with a middle section of the groove, and the first scavenging orifice and the second scavenging orifice being formed among two sides of the rib and the groove, wherein a thickness of the rib is less than a depth of the groove, and an inner wall of the rib flushes with an internal portion of the external fence.

3. The cylinder structure as claimed in claim 1, wherein the respective positioning element further has a spring and a protrusion fixed on a second end of the stem, the spring is fitted on the stem and abuts against the multiple hooks and the protrusion, after the respective positioning element is inserted through the first fixing orifice and the respective second fixing orifice, the protrusion is operated so that the multiple hooks engage with the internal wall of the respective lid.

4. The cylinder structure as claimed in claim 3, wherein the respective positioning element further has a threaded orifice defined on the second end of the stem, and the respective positioning element has a screw peg extending from the protrusion and screwed in the threaded orifice of the stem.

5. The cylinder structure as claimed in claim 1, wherein the first fixing orifice of the body has a first receiving portion, a diameter of the first receiving portion is more than a diameter of the stem, and the first fixing orifice further has multiple first extensions extending outward from the first receiving portion, wherein the stem of the respective positioning element is inserted through the first receiving portion, and the multiple hooks of the stem are inserted through the multiple first extensions.

6. The cylinder structure as claimed in claim 1, wherein the respective second fixing orifice of the respective lid has a second receiving portion, and a diameter of the second receiving portion is more than a diameter of the stem, the respective second fixing orifice further has multiple second extensions extending outward from the second receiving portion, wherein the stem of the respective positioning element is inserted through the second receiving portion of the respective second fixing orifice, and the multiple hooks of the stem are inserted through the multiple second extensions.

7. The cylinder structure as claimed in claim 1, wherein the respective lid has a second engagement portion formed on a peripheral side thereof, and the second engagement portion of the respective lid is inserted into the first engagement portion of the body and is adhered by an airtight material, thus connecting the respective lid on the body.

8. The cylinder structure as claimed in claim 7, wherein the first engagement portion of the body is concaved, and the second engagement portion of the respective lid is convex.

9. The cylinder structure as claimed in claim 1 further comprising a molybdenum coating layer coated on the internal portion of the external fence of the body.

* * * * *